US005832842A

United States Patent [19]

Frontini et al.

[11] Patent Number: 5,832,842

[45] Date of Patent: Nov. 10, 1998

[54] SYSTEM FOR THE AUTOMATIC ADMISSION AND REGULATION OF THE FLOW-RATE OF A BASIC SUBSTANCE ADMITTED TO REFUSE INCINERATION PLANTS FOR THE HOT DESTRUCTION OF THE ACIDS IN THE COMBUSTION FUMES

[75] Inventors: Luis Frontini; Francesco Repetto, both of Genoa, Italy

[73] Assignee: Finmeccanica S.p.A. Azienda Ansaldo, Genoa, Italy

[21] Appl. No.: 706,723

[22] Filed: Sep. 6, 1996

[30] Foreign Application Priority Data

Sep. 29, 1995 [EP] European Pat. Off. ..... 95830402

[51] Int. Cl.[6] ..... F23N 5/02; F23N 5/00; F23N 5/18; F23J 15/00

[52] U.S. Cl. ..... 110/190; 110/188; 110/186; 110/185; 110/203; 110/215; 431/76; 431/78; 431/79

[58] Field of Search ..... 110/188, 187, 110/185, 186, 189, 190, 297, 301, 203, 215, 341, 342, 343, 344, 345, 346; 431/4, 12, 76, 78, 79

[56] References Cited

U.S. PATENT DOCUMENTS

| | | | |
|---|---|---|---|
| 4,421,036 | 12/1983 | Brannstrom et al. | 110/186 |
| 4,793,268 | 12/1988 | Kukin et al. | 110/343 |
| 4,886,519 | 12/1989 | Hayes et al. | 44/301 |
| 5,024,171 | 6/1991 | Krigmont et al. | 110/345 |
| 5,158,024 | 10/1992 | Tanaka et al. | 110/186 |
| 5,185,134 | 2/1993 | Gullett | 423/240 R |
| 5,252,060 | 10/1993 | McKinnon et al. | 431/12 |
| 5,275,553 | 1/1994 | Frish et al. | 431/76 |
| 5,326,536 | 7/1994 | Carter | 422/111 |
| 5,425,316 | 6/1995 | Malone | 110/190 |
| 5,503,089 | 4/1996 | Frontini et al. | 110/185 |

FOREIGN PATENT DOCUMENTS

| | | | |
|---|---|---|---|
| 0380143 A2 | 8/1990 | European Pat. Off. | B01D 53/30 |
| 0605041 A1 | 7/1994 | European Pat. Off. | F23J 7/00 |
| 4027040 | 12/1991 | Germany | B01D 53/34 |
| 2-33514 | 2/1990 | Japan | 431/4 |
| 2 169 726 | 7/1986 | United Kingdom | 431/12 |
| WO95/08081 | 3/1995 | WIPO | F23N 5/00 |

*Primary Examiner*—Ira S. Lazarus
*Assistant Examiner*—Ljiljana V. Ciric
*Attorney, Agent, or Firm*—Sheridan Ross P.C.

[57] ABSTRACT

A system for automatically admitting and regulating the flow-rate of an alkaline substance admitted to the combustion chamber (10) of a refuse incineration plant for the hot destruction of the acids contained in the combustion fumes, comprising sensors (22, 23, 24, 25, 51, 124, 140) for detecting the concentration of the acids in the fumes in the combustion chamber (10) and working conditions of the plant such as temperature, flow-rate and humidity of the fumes, and processing means (26, 27) connected to the sensors for identifying, in dependence on the concentration of acids and of the working conditions, a flow-rate of an alkaline substance to be admitted to the combustion chamber in order to achieve a destruction yield which reduces the concentration of acids in the fumes discharged from the plant to a predetermined value, and for operating flow-rate regulation members (40) for admitting to the combustion chamber the flow-rate of an alkaline substance thus identified.

7 Claims, 3 Drawing Sheets

SYSTEM FOR THE AUTOMATIC ADMISSION AND REGULATION OF THE FLOW-RATE OF A BASIC SUBSTANCE ADMITTED TO REFUSE INCINERATION PLANTS FOR THE HOT DESTRUCTION OF THE ACIDS IN THE COMBUSTION FUMES

BACKGROUND OF THE INVENTION

1) Field of the Invention

The present invention relates to a system for the automatic admission and regulation of the flow-rate of a basic substance admitted to refuse incineration plants for the hot destruction of the acids in the combustion fumes.

2) Description of the Prior Art

It is known that a crucial problem in present-day industrial communities is the disposal of solid urban refuse and toxic noxious refuse which is left over from industrial operations and which, with regard to its very low biodegradability and/or high toxicity, cannot be introduced into the environment or collected in dumps.

The widespread use of plastics materials, synthetic rubbers, composite materials, paints and dyes in industrial production has made this problem particularly serious and has required the use of means for the destruction of the molecular system of these materials based essentially on the heating/combustion and reduction of the materials to elementary substances with simple molecular structures.

The process is carried out in incineration plants in which the heterogeneous nature of the materials to be incinerated, which are largely combustible, is utilized to feed the combustion, possibly with the external supply of fuel which causes the fumes to reach temperatures of the order of 900° C. and even more, so as to ensure the decomposition of the volatile substances and of the powders in the fumes.

The heat produced by the combustion process is preferably recovered by means of boilers for producing steam and by exchangers and is distributed to users of various types.

The combustion fumes cannot, however, be discharged freely to the atmosphere since they contain considerable quantities of acid substances, particularly HCl.

It is therefore necessary to destroy the acid substances in the fumes before they are discharged to the atmosphere and, in all industrial countries, standards are in force which establish an upper limit for the concentration of acid substances in fumes released into the atmosphere.

To improve the efficiency of the processes for the destruction of the acid substances and to prevent the problems connected with the use of expensive and bulky scrubbing towers for the fumes, in recent years, systems have been developed for the hot destruction of the acids in the fumes and these provide for basic substances such as calcium carbonate powder or hydrated lime and powdered rock with a high calcareous content, more generally, to be injected into the combustion chamber.

The basic substance, which is calcined by the high temperature of the combustion fumes, reacts with the acid substances and to a large extent neutralizes them with the formation of salts.

The efficiency of these destruction systems is particularly high since the reaction of the acids develops throughout the path of the fumes through the plant and not only in the final portion, increasing the useful reaction time.

Moreover, the reaction develops predominantly at high temperatures which favours reaction speed and largely prevents the formation of toxic halogenated compounds such as dioxins and furans.

Prior art destruction systems are described in the patent U.S. Pat. No. 5,185,134 and in European patent application EP-A-0600541 which provide for the injection of a basic substance (such as $CaCO_3$ and $Ca(OH)_2$), in the former case into the hottest region of the incinerator fumes and in the latter into the flame of an auxiliary burner which favors the calcination and the activation of the basic substance irrespective of the temperature of the fumes.

European patent application EP-A-0605041 also proposes that the flow of basic substance be controlled in dependence on the concentration of acid substances in the fumes, starting with the assumption that, since the yield of the destruction process is high and predictable it is controlled so that the flow is commensurate with the concentration of acid substances in the fumes according to a stoichiometric ratio or in proportion thereto.

The solution proposed is particularly attractive but can be improved substantially.

In the systems described for the hot destruction of the acidity of the fumes of incineration plants, there are, in fact, considerable problems and disadvantages which result from conflicting requirements.

Since the calorific value of the refuse to be incinerated is greatly variable, the temperature of the fumes is greatly variable with quite rapid transitions not only during the starting up and extinguishing of the incinerator plant but also during normal working. It is not possible to moderate these transitions by variations of the flow-rate of refuse.

Although in optimal conditions with the maximum calorific value of the refuse, the temperature of the fumes in the combustion chamber may reach and exceed 950° C., which is an optimal temperature for the decomposition of the volatile organic substances transported by the fumes, in transitory situations, it may even be below 800° C. which is the minimum temperature necessary and in any case not the optimal temperature to achieve calcination of the calcium carbonate and powders with a calcareous base.

It is therefore necessary to supplement the combustion of the refuse by the supply of heat developed by auxiliary heaters or post-heaters the thermal power of which is adequate to limit the range of the drops in temperature of the fumes, which, in the case of the combustion of refuse with a high calorific value, may involve fume temperatures well in excess of 950° C.

Fume temperatures below 800° C. are insufficient to bring about adequate calcination of the alkaline substance, generally $CaCO_3$, but fume temperatures in excess of 950° C. may cause dead-burn phenomena of the calcium oxide produced which substantially reduce its ability to react with the acid substances.

The yield of the process for the destruction of the acid substances is not constant but depends upon several variables, amongst which are:

- the transit time of the fumes through the plant and hence the flow-rate of the fumes,
- the temperature of the fumes,
- the concentration of acid substances,
- the concentration of alkaline substances.

Low fume flow-rates corresponding to the operation of the plant at reduced capacity increase the transit time and the acid conversion yield.

High fume temperatures increase the speed of the conversion reaction but, at the same time, shift the equilibrium condition of the conversion reaction of the acids towards the maintenance of a considerable proportion of the acids, with a consequent reduction of the theoretical conversion yield possibly to only 30%.

Increases in the concentrations of the alkaline and acid substances lead to an increase in the conversion yield.

In this respect, it is known that, to favor high conversion yields, even at high temperatures, in the process for the hot destruction of acidity in fumes, there is a tendency to operate with flow-rates of alkaline substance greatly in excess of the stoichiometric ratio relative to the concentration of acid substances in the fumes.

This ensures a high conversion yield adequate for the purposes regardless of the concentration of acid substances, of the temperature of the fumes and of their flow rate but has the serious disadvantage of a high consumption of basic substance and of its accumulation as an encrustation in the incineration plant downstream of the combustion chamber, particularly in the tube nests of the recovery boiler.

As well as considerably increasing the running cost owing to the high consumption of alkaline substance, this reduces the recovery efficiency of the plant and requires frequent cleaning thereof which is a further burden.

It is therefore desirable to limit the consumption of basic substance as much as possible by a usage thereof which ensures that the standards are respected for any working condition of the plant, and consequently protects the environment.

SUMMARY OF THE INVENTION

The system for automatically admitting and regulating the flow-rate of a alkaline substance of the present invention satisfies this requirement and ensures optimal use of the basic substance admitted, regardless of the temperature of the fumes, and regulates the flow-rate thereof admitted in dependence on the variables which can influence the destruction yield, such as the concentration of acid substances in the fumes in the combustion chamber, the flow-rate of the fumes and possibly also the temperature and humidity of the fumes to ensure, for any concentration of acid substances greater than a predetermined limit, a conversion yield which guarantees the emission of fumes to the atmosphere with a concentration substantially equal to the limit.

These results are achieved by a regulation system with the features set out in appended claim 1 and with further advantageous features specified in the dependent claims.

BRIEF DESCRIPTION OF THE DRAWINGS

The features and advantages of the present invention will become clearer from the following description of a preferred embodiment and from the appended drawings, in which.

DETAILED DESCRIPTION OF THE PREFERRED EMBODIMENTS

Before the regulation system of the present invention is considered, it is appropriate to set out some considerations of a general character.

The concentration of HCl contained in the fumes developed in the combustion chamber of an incineration plant is indicated $[HCl]_1$ and the destruction yield of the plant is indicated $\eta$, the fraction of HCl captured per unit volume of fumes is given by $\eta.[HCl]_1$. The fraction present in the fumes discharged by the plant, that is, the concentration of HCl in the fumes discharged from the plant is given by $$[HCl]_2=[HCl]_1.(1-\eta) \quad (1)$$

If the objective of the acidity destruction is to ensure a concentration $[HC1]_2$ equal to a predetermined safety level K (which in turn may advantageously be less than a limit K1 established by the standards), equation (1) defines the destruction yield which the plant has to have for any concentration of HCl in the fumes:

$$[HCl]_1.(1-\eta)=K, \text{ that is } \eta=1-K/[HCl]_1 \quad (2)$$

Figure 1:
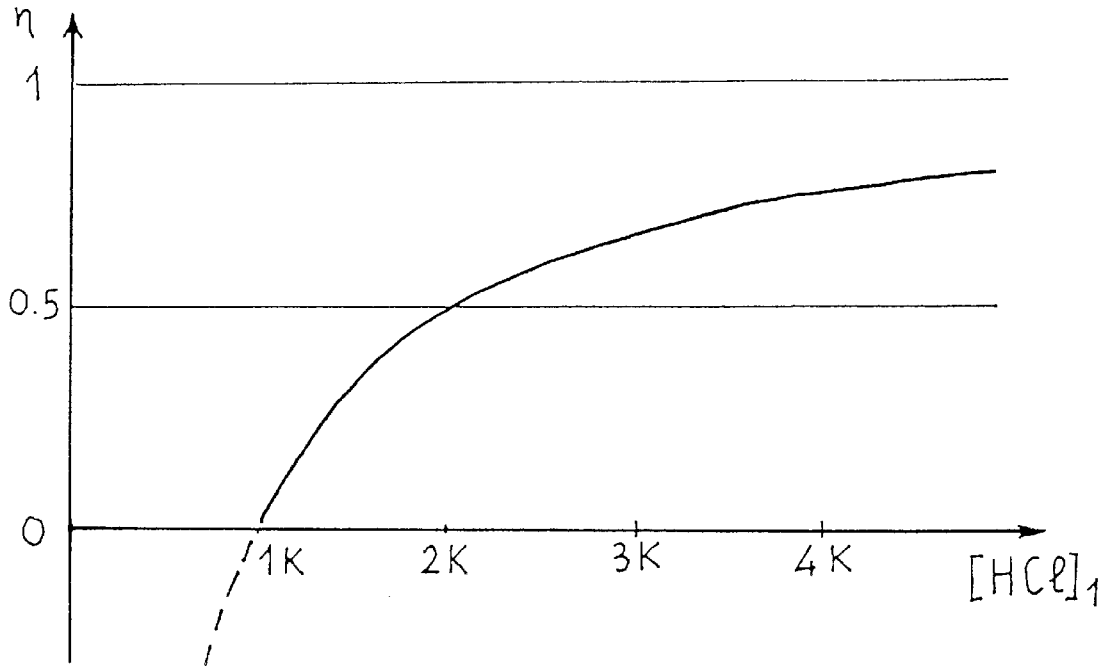
FIG. 1 is a Cartesian graph showing the destruction yield necessary to reduce the concentration of HCl in the fumes discharged from an incineration plant to a predetermined value as a function of the concentration of HCl present in the combustion chamber.

FIG. 1 is a Cartesian graph representing equation (2) which represents a portion of a hyperbola and shows clearly that if $[HCl]_1<=K$ the conversion yield may be zero since the concentration of acids in the fumes is intrinsically less than or equal to the maximum permissible concentration, whereas for $[HCl]l>K$ the yield $\eta$ must be greater the higher the concentration.

At the limit, for $[HCl]_1>>K$, $\eta$ must be equal to 1.

The HCl destruction process uses the chemical reaction:

$$CaO+2HCl=CaCl_2+H_2O \quad (3)$$

in which CaO is generally obtained by the calcination of carbonate ($CaCO_3 \rightarrow CaO+CO_2$) or hydrate ($Ca(OH)_2 \rightarrow CaO+H_2O$).

Equation (3) does not guarantee that in the presence of CaO and HCl in a stoichiometric ratio all of the HCl acid will be converted into salt; as in all chemical reactions, there is a thermodynamic equilibrium condition which limits the development of the reaction in one direction or in the other and which varies with temperature.

Since the reaction (3) is exothermic, the equilibrium of the reaction moves towards the left, that is, it favours the conservation of a larger fraction of CaO and HCl with increased temperature.

Moreover, a chemical reaction is not an instantaneous phenomenon but statistic of the interaction between molecules or atoms and thus develops over time with a decreasing speed which depends upon the concentrations of the reacting substances.

The equilibrium condition is therefore achieved after an infinite time.

Finally, by the mass action law extended to heterogeneous (solid-gas-liquid) systems, the equilibrium condition of the system is variable in dependence on the concentrations of the components and the reaction equation (3) can be written as:

$$\frac{[CaO]\cdot[HCl]^2}{[CaCl_2]\cdot[H_2O]} = K(t) \quad (4)$$

where the terms in square brackets represent the concentrations of the various components and K(t) is the equilibrium constant of the reaction for the temperature considered.

Since a heterogeneous system is concerned, whereas the finely pulverized calcium oxide can to a certain extent be compared to a gas, the calcium chloride resulting from the destruction reaction, which at the reaction temperature is in the liquid or solid state, scarcely influences the equilibrium condition and equation (4) can be simplified as follows:

$$\frac{[CaO]\cdot[HCl]^2}{[H_2O]} = K(t) \quad (5)$$

Clearly, therefore, the greater the concentration of CaO, the more the concentration of HCl in the system has to be reduced, with a corresponding increase of $H_2O$ and $CaCl_2$.

Equation (4), which is rigorously valid for homogeneous gaseous systems is also qualitatively valid in heterogeneous systems and shows, incidentally, that the humidity of the fumes can adversely influence the conversion yield and that the use of calcium carbonate for the destruction of hydrochloric acid is preferable to the use of hydrated lime $Ca(OH)_2$, the calcination of which causes the development of $H_2O$ and consequently a decrease in the conversion yield.

It also indicates that the use of atmospheric air as a vehicle for transporting the alkaline substance is preferable to the use of a liquid vehicle such as water.

More significantly, equation (4) indicates that by controlling the concentration of CaO it is possible to modify K and hence the conversion yield of the acidity destruction process.

In an incineration plant, the concentration of CaO is unambiguously correlated to the flow-rate of $CaCO_3$ admitted to the plant and to the flow-rate of the fumes and, in practice, is the only parameter which can be modified in order to control the acidity concentration whereas the temperature of the fumes and the flow-rate are variables which are already controlled for the purposes of the combustion process.

It is thus possible, on the basis of theoretical models, and preferably of experiments, to define for an incineration plant a family of curves, one for each possible working condition, which describe the conversion yield of the acid substances in the plant as functions of the concentration of alkaline substance relative to the concentration of HCl and expressed, for example, as the excess E over the stoichiometric concentration:

$$E = \frac{[CaO]_o - [CaO]_{st}}{[CaO]gt}$$

where $[CaO]_o$ is the concentration actually admitted to the fumes, and $[CaO]_{st}$ is the concentration which is in a stoichiometric ratio with the concentration of HCl.

Figure 2:
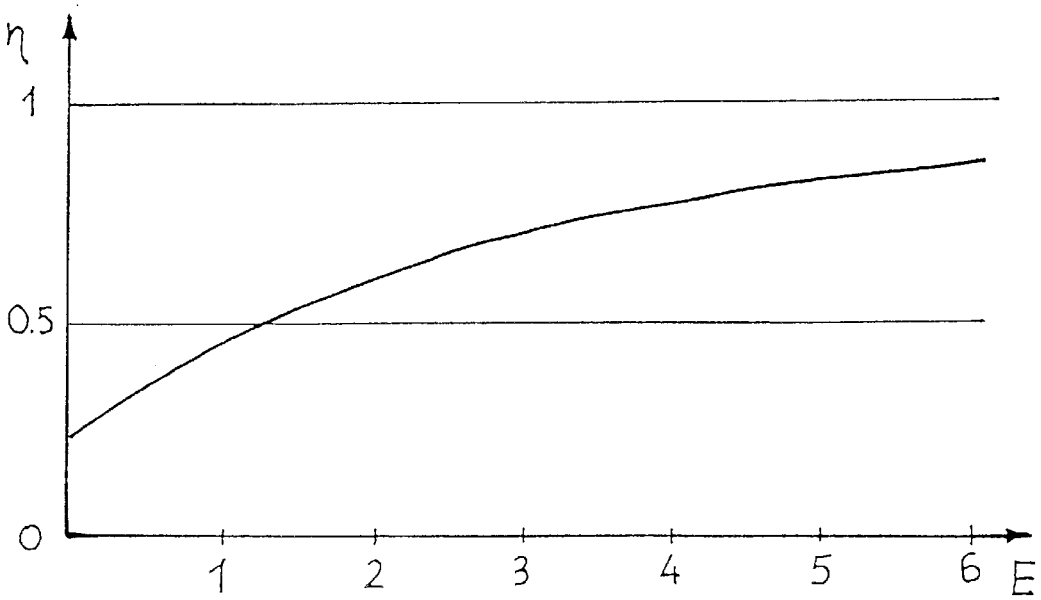
FIG. 2 is a Cartesian graph showing, for predetermined working conditions of an incineration plant, the destruction yield of acids contained in the fumes as a function of the excess E, in relation to the stoichiometric ratio of the alkaline substance admitted to the combustion chamber of the plant.

FIG. 2 shows qualitatively one of these curves for a predetermined working condition (initial HCl concentration, flow-rate, temperature profile of the fumes, humidity of the fumes).

If the initial concentration of acid substance $[HCl]_1$ is known, it is thus possible from equation (2) and from the corresponding graph of FIG. 1, to define the conversion yield η necessary to bring the acidity of the fumes discharged from the plant down to the maximum permissible level K and, by means of the family of curves represented by the graph E, to identify the excess E of alkaline substance which enables the necessary conversion yield to be obtained for the working conditions identified.

If the excess E and the flow-rate of the fumes is known, the flow-rate of basic substance such as $CaCO_3$ to be admitted can readily be determined.

The various steps of the logic process which lead to the identification of the necessary flow-rate of the alkaline substance are shown separately for conceptual clarity.

In practice, it is possible to define a family of curves which can also be described by numerical tables which define, for each working condition, the flow-rate of alkaline substance necessary to bring the concentration of HCl in the fumes down to a predetermined level.

Figure 3:
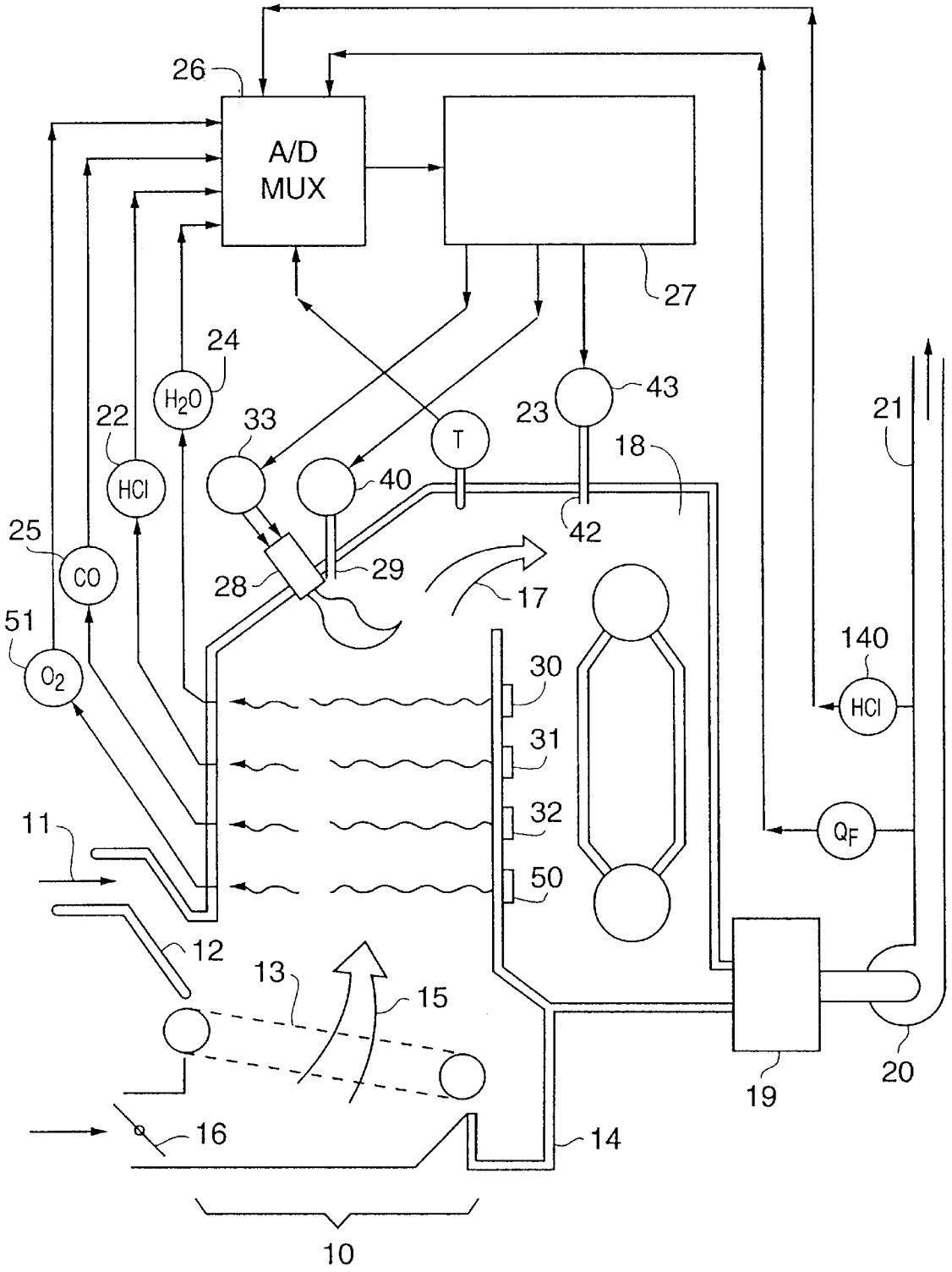
FIG. 3 shows, in the form of a block diagram, an incineration plant with a preferred embodiment of the system for automatically admitting and regulating the flow-rate of a alkaline substance admitted to the plant for the hot destruction of the acids contained in the combustion fumes.

With these introductory remarks, the regulation system shown in FIG. 3 can readily be understood.

In FIG. 3, a generic incineration plant comprises a combustion chamber 10 to which refuse 11 is admitted for incineration through a load opening 12.

A movable grating or rotary feed drum 13 transports the refuse through the combustion chamber and discharges the residual slag in a collection pit 14.

A combustion air flow 15 feeds the combustion passes through the grating 13 and is controlled by regulating shutters.

The combustion of the refuse develops fumes 17 at a temperature which is variable in dependence on the calorific value of the refuse and the content of acid substances, particularly HCl, which is also variable.

The fumes pass from the combustion chamber 10 which, if necessary, also comprises a post-combustion chamber, to a recovery section 18 and from there, having been cooled, to a filtration section 19 from which they are drawn by fans 20 in order to be conveyed to a chimney 21.

The plant is regulated by a processing and control system which comprises a plurality of sensors 22, 23, 24, 25, an analog/digital conversion and multiplexing unit 26, a processing and control unit 27, which is preferably digital, and suitable control members.

A temperature sensor 23 provides the unit 27 with an indication of the temperature of the fumes discharged from the combustion chamber.

If the temperature is less than a predetermined value, for example 900° C., the unit 27 operates devices 33 for igniting one or more auxiliary burners 28 supplied with fuel with a high calorific value, such as gas oil or the like, to raise the temperature of the fumes, for example to 950° C., the auxiliary burners being extinguished when this has been achieved.

ON-OFF regulation with a dead band is preferred for its simplicity, safety and the efficiency of the burners but may be replaced by proportional regulation.

A nozzle 29 is advantageously associated with at least one of the auxiliary burners 28 for injecting a alkaline substance in powder form, preferably $CaCO_3$ and, more generally, calcareous rock powder into the region of the flame developed by the burner when lit.

As described in the European published document EP-A-0605041, this ensures quick and effective calcination of the alkaline powder even if the temperature of the fumes is below 900° C. and hence insufficient to cause rapid calcination.

The time spent by the alkaline powder in the flame, which is of the order of a fraction of a second, ensures that the dead-burn phenomenon does not occur even if the temperature of the flame is particularly high.

When the temperature of the fumes is high enough and the burner 28 is extinguished, the heat content of the fumes ensures calcination of the alkaline substance admitted.

The fineness of the alkaline powder admitted plays an important part in the conversion yield; the finer it is the more similar is its behaviour to that of a gaseous phase, but the more expensive is its production and the more difficult is its handling and the control of its flow-rate.

In practice, an optimal dimension which reconciles the various requirements is between 40 and 100 $\mu$m.

The flow-rate of alkaline substance admitted to the combustion chamber through the nozzle 29 is completely independent of the lit/extinguished condition of the burner 21 and is controlled by the unit 27 in dependence on the acidity of the fumes according to a predetermined, non-proportional relationship.

The chemical composition of the combustion fumes can be monitored continuously or almost continuously by known means, for example, by continuous sampling and analysis by means of a mass spectrograph.

As shown in FIG. 3, the quantitative analysis of the fumes is preferably carried out by means of a plurality of laser diodes 30, 31, 32, 50 tuned to characteristic absorbency frequencies of the components of greatest interest, for example, CO (diode 32), $H_2O$ (diode 30), HCl (diode 31) and $O_2$ (diode 50).

The electromagnetic radiation emitted by the diodes, which is attenuated by absorbtion as it passes through the fumes in dependence on the concentrations of the various chemical species, is received, via optical guides, by respective sensors 22, 24, 25, 51 each of which transmits the to A/D converter 26 a signal correlated with the concentration of the chemical species monitored, CO, $H_2O$, HCl, and $O_2$, respectively, in the fumes.

The A/D converter also receives from a sensor 124 an indication of the flow-rate of the fumes.

Whereas the detection of at least the concentration of HCl is carried out upstream of the nozzle 29 for injecting the alkaline substance, with reference to the path of the fumes, as shown in FIG. 3, the flow-rate sensor 124 may be disposed at any point on the path of the fumes.

The data collected by the converter 26 and converted into digital form are transferred periodically at a suitable frequency, for example, with a period of a few milliseconds, to the processing unit 27 which can then identify the working conditions of the plant and their changes practically continuously and can consequently control the temperature of the fumes, as already seen, the flow-rate of the fumes and hence of combustion air in order to optimize the combustion process, and the flow-rate of alkaline substance admitted to the fumes to reduce their concentration of acids, principally HCl, to a predetermined level.

Figure 4:
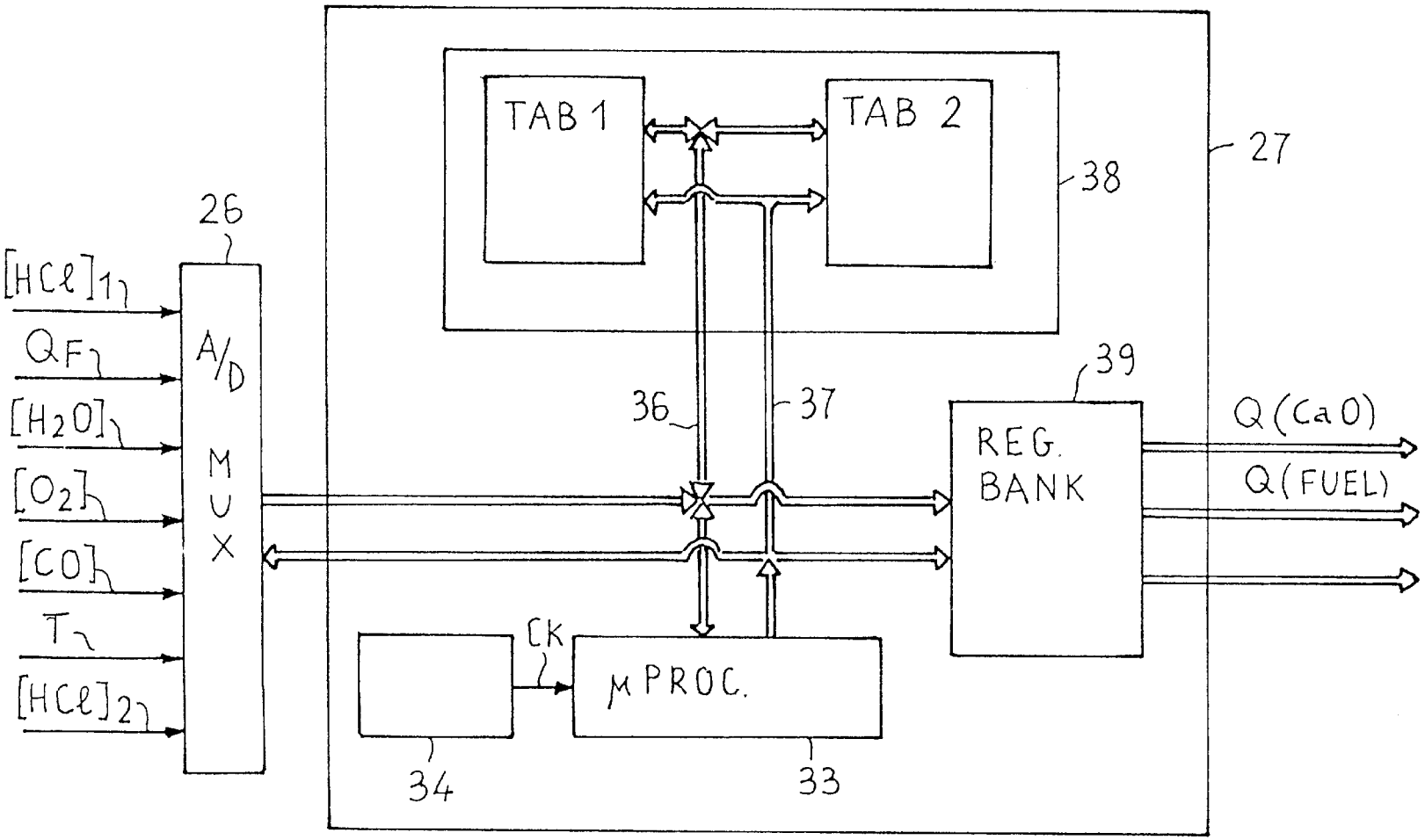
FIG. 4 shows the regulation system of FIG. 3 in greater detail, in the form of a block diagram.

FIG. 4 shows, in a block diagram, the architecture of the processing unit 27 and its interconnection with the convertor 26 and various regulatory members.

The processing unit 27 comprises a conventional microprocessor 33 with a timing oscillator 34 which generates a clock signal CK.

The microprocessor 33 has a data input/output channel (DAT) 36 and an addressing and control channel (ADDR/COM) 37 by means of which it communicates with the converter 26, with a read/write working memory 38 and with a bank of output registers 39 for stabilizing output commands.

An external control memory also be provided for the microprocessor but many microprocessors available on the market do not need one since an internal control memory is already present.

The operation of the processing unit 27 with regard to the control of the acidity of the fumes is as follows.

The microprocessor 33 interrogates the converter 26 periodically and receives therefrom a plurality of binary codes indicative of:

the concentration $[HCl]_1$ of HCl detected in the combustion chamber, the flow-rate QF of the fumes, the temperature T of the fumes at the output or inside the combustion chamber.

This set of codes which define a specific working condition of the plant is used by the microprocessor 33 to address a specific location of a table (TAB1) in the memory 38.

A code representative of the flow-rate of basic substance (CaO) to be admitted to the fumes in order to correct their acidity and limit it to a predetermined value for the working conditions identified by the address code is stored at each location of the table TAB1.

The code Q(CaO) read in the table TAB1 is loaded by the microprocessor 33 in a register of the bank 39 where it remains latched until a new interrogation of the convertor 26 and reading of TAB1.

The code Q(CaO) present at the output of the register bank 39 controls a member 40 (FIG. 3) for regulating the flow-rate of the basic substance, for example, a flow-rate modulator valve.

If the specific working conditions of the plant are such that the flow-rate of fumes and the temperature of the fumes are practically constant, the regulation of the flow-rate Q(CaO) can be based simply on the monitoring of the concentration $[HCl]_1$.

If, on the other hand, the humidity of the fumes is greatly variable and significantly influences the conversion yield, it is possible to take account of this variable factor in the compilation of TAB1 and also to detect this variable systematically with the sensor 24 (FIG. 3).

The regulation system described is also suitable for fine calibration either at an initial stage of the setting-up of the plant, or continuously by specific automatic learning techniques of the expert systems.

In this connection, as shown in FIG. 4, a table TAB2 is provided in the memory 38 for storing the working conditions in the plant during the most recent working period over a time interval at least equal to the transit time of the fumes through the plant.

The working conditions already considered ($[HCl]_1$, T, QF, $[H_2O]$) and in addition to these, the corresponding flow-rate Q(CaO) of alkaline substance admitted are stored at each position of the table.

Each position of the table corresponds to a predetermined moment in time of the period stored which, if necessary, may also be identified by the storage of a time identification code in the position of the table.

As shown in FIG. 3, a detector 140 of the concentration $[HCl]_2$ of acid in the fumes discharged by the plant may be disposed, permanently or solely during the setting-up of the plant, at the output of the plant, for example, at the base of chimney 21.

The detector sends a code representative of the concentration measured to the processing unit 27 by means of the A/D converter 26.

The processor 33 (FIG. 4) compares the code received with a reference code representative of the predetermined desired acid concentration of the fumes discharged and, if it detects a deviation from the desired value towards an excess or a shortage, interrogates table TAB2.

By reading TAB2, the microprocessor 33 can find the transit time of the fumes through the plant in the immediately preceding period and can trace the preceding working conditions, as a result of which a deviation from the desired acidity conditions of the fumes discharged was identified.

The flow-rate code Q(CaO) in the table TAB1 can therefore be corrected according to the error detected by suitable algorithms for the working conditions identified in the table TAB2 and, preferably also for working conditions close thereto by suitable extrapolations.

When the plant is working in the same conditions again or in working conditions close thereto, the same regulation error is thus prevented or at least significantly attenuated.

In other words, if the regulation system is set incorrectly or approximately, a regulation defect resulting from this imprecision cannot be corrected the first time this defect is identified (the correction would in fact require retrospective intervention) but it can be ensured that the same error is not repeated subsequently.

The foregoing description relates solely to a preferred embodiment of the invention and, clearly, many variations may be applied.

For example, as shown in FIG. 3, instead of an injector such as 29 which admits the alkaline substance to the flame of an auxiliary burner 23, an injector 42 which is controlled by regulation members 43 and which admits the basic substance directly into the combustion fumes without the support of a heater may be provided.

Moreover, although reference has been made in the foregoing description solely to hydrochloric acid as the acid substance contained in the fumes, the regulation system may be provided with supplementary equipment to identify the presence of other substances such as bromic acid, hydriodic acid and sulphur trioxide which are susceptible to hot destruction by alkaline substances with the formation of salts.

What is claimed is:

1. A system for automatically admitting and regulating a flow rate of an alkaline substance admitted to an incineration plant for hot destruction of acids contained in combustion fumes developed in a combustion chamber of the plant, said system comprising:

detection means for detecting a concentration of acids contained in said combustion fumes in the combustion chamber and for providing an indication of said concentration;

admission means for admitting said alkaline substance to the combustion chamber;

processing means for receiving the indication of said concentration of acids in said combustion fumes in order to determine the flow rate of the alkaline substance admitted to the combustion chamber required for achieving a destruction yield reducing said concentration of acids in said combustion fumes discharged from the plant to a predetermined value and to provide an indication of said flow rate of the alkaline substance;

regulation members receiving, as an input, said indication of the flow rate of the alkaline substance, said members connected to said admission means in order to set said admission means for the admission of the alkaline substance at a flow rate equal to the flow rate identified by said processing means;

measuring means for measuring one or more of the following parameters defining working conditions of the plant and supplying the processing means with an indication of said one or more parameters;

flow rate of said combustion fumes, temperature of said combustion fumes in said combustion chamber; and, humidity of said combustion fumes in said combustion chamber;

wherein said measuring means supplies the processing means with at least an indication of the temperature of said fumes in said combustion chamber and wherein said admission means comprises an auxiliary burner for producing of a flame in the combustion chamber and a first nozzle for admitting the alkaline substance to the flame, the system also comprising a control means which receives the indication of the temperature in order to control ignition and extinguishing of said auxiliary burner based on the temperature of said fumes in said combustion chamber.

2. A system according to claim 1 where said measuring means supplies the processing means with at least an indication of the temperature of said fumes in said combustion chamber and wherein said admission means comprises an auxiliary burner for producing a flame in the combustion chamber and a first nozzle for admitting the alkaline substance to the flame, the system also comprising a control means which receives the temperature indication in order to control ignition and extinguishing of said auxiliary burner based on the temperature of said fumes in said combustion chamber.

3. A system according to claim 1, where said admission means comprises a second nozzle for admitting of the alkaline substance to the combustion chamber.

4. A system according to claim 1 where the processing means comprises a memory and, stored in said memory, a first table (TAB1) containing a description of the flow rate of the alkaline substance necessary to reduce the concentration of acids in the fumes discharged from the plant to a predetermined value corresponding to different working conditions of the plant.

5. A system according to claim 4, further comprising means for detecting the concentration of acids in the fumes discharged from the plant and for providing an indication of said concentration to the processing means, said processing means comprising a second table (TAB2) stored in said memory and descriptive of a most recent working condition of the plant during a time interval at least equal to a transit time for the fumes through the plant, the processing means being programmed to identify a deviation from the predetermined value of the concentration of acids in the fumes discharged from the plant, to identify, in the second table (TAB2), working conditions in the plant correlated with the deviation and to correct the description in the first table (TAB1) based on the deviation.

6. A system according to claim 1 where the processing means comprises a memory and, stored in said memory, a first table (TAB1) containing a description of the flow rate of the alkaline substance necessary to reduce the concentration of acids in the fumes discharged from the plant to a predetermined value corresponding to different working conditions of the plant.

7. A system according to claim 6, further comprising means for detecting the concentration of acids in the fumes discharged from the plant and for providing an indication of said concentration to the processing means, said processing means comprising a second table (TAB2) stored in said memory and descriptive of a most recent working condition of the plant during a time interval at least equal to a transit time for the fumes through the plant, the processing means being programmed to identify a deviation from the predetermined value of the concentration of acids in the fumes discharged from the plant, to identify, in the second table (TAB2), the working conditions in the plant correlated with the deviation and to correct the description in the first table (TAB1) based on the deviation.

* * * * *